US006279558B1

(12) United States Patent
Fukuda

(10) Patent No.: US 6,279,558 B1
(45) Date of Patent: Aug. 28, 2001

(54) IGNITION APPARATUS OF INTERNAL COMBUSTION ENGINE

(75) Inventor: Daiki Fukuda, Fuji (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/488,757

(22) Filed: Jan. 21, 2000

(30) Foreign Application Priority Data

Jan. 21, 1999 (JP) ..... 11-013578

(51) Int. Cl.[7] ..... F02P 3/08
(52) U.S. Cl. ..... 123/651; 123/599
(58) Field of Search ..... 123/650, 651, 123/652, 599, 600

(56) References Cited

U.S. PATENT DOCUMENTS 3,863,616 * 2/1975 Wood ..... 123/600
4,132,208 * 1/1979 Yukawa ..... 123/600
4,342,304 * 8/1982 Watanabe ..... 123/599
4,380,224 * 4/1983 Van Siclen, Jr. ..... 123/602
4,610,237 * 9/1986 Ionescu et al. ..... 123/600
4,958,608 * 9/1990 Saito et al. ..... 123/651
5,954,027 * 9/1999 Suzuki ..... 123/600

FOREIGN PATENT DOCUMENTS 5-164031 6/1993 (JP) .
6-307318 11/1994 (JP) .

* cited by examiner

*Primary Examiner*—Erick Solis
(74) *Attorney, Agent, or Firm*—Kenyon & Kenyon

(57) ABSTRACT

In an ignition apparatus, voltage is induced in a primary coil by a permanent magnet being rotated together with rotation of an output shaft of an engine. As the output shaft rotates, protrusions also revolve, inducing voltage in an electromagnetic pickup. Depending on the induced voltage in the pickup, a switching element is switched on or off. The switching-off timing of the switching element is set as an ignition timing. Therefore, at the ignition timing, the current through the primary coil is sharply cut off, so that great voltage is induced in a secondary coil and is applied to an ignition plug.

6 Claims, 15 Drawing Sheets

IGNITION APPARATUS OF INTERNAL COMBUSTION ENGINE

INCORPORATION BY REFERENCE

The disclosure of Japanese Patent Application No. HEI 11-13578 filed on Jan. 21, 1999 including the specification, drawings and abstract is incorporated herein by reference in its entirety.

BACKGROUND OF THE INVENTION

1. Field of the Invention

The present invention relates to an ignition apparatus of an internal combustion engine that induces current through a primary coil by rotational movement of an ignition power-generating permanent magnet based on rotation of an output shaft of the internal combustion engine, and discontinues the induced current to induce a voltage across a secondary coil, and applies the voltage induced across the second coil to an ignition plug of the internal combustion engine.

2. Description of the Related Art

A known ignition apparatus of an internal combustion engine is a magneto ignition apparatus. The magneto ignition apparatus includes a permanent magnet mounted to an output shaft of an internal combustion engine, and a primary coil disposed near the permanent magnet. Therefore, current is induced in a primary coil by changes of the magnetic field created by rotational movement of the permanent magnet. An electric line connected to the primary coil is provided with a switch that discontinues or cuts off the current through the primary coil periodically at an engine ignition timing. A great change in current, that is, discontinuation of current, induces a high voltage across the secondary coil facing the primary coil. The voltage induced in the secondary coil is applied to an ignition plug of an internal combustion engine, so that the ignition plug produces discharge.

The switch for discontinuing current through the primary coil can be operated by various control devices, for example, a microcomputer. Japanese Patent Application Laid-Open No. HEI 6-307318, as for example, discloses a construction in which a microcomputer detects a current flowing through the primary coil, and determines an ignition timing based on the detected current, and accordingly switches off a transistor switch.

Normally, the microcomputer or the like is driven by an external power source. Therefore, if the external power source fails, it becomes impossible to perform ignition. Furthermore, a failure of the computer itself also makes it impossible to perform ignition.

Therefore, it is necessary to perform the aforementioned switching on and off by using a more reliable hardware circuit while omitting an external power source. In a conventional circuit, therefore, a cam is provided on an output shaft of the engine. The aforementioned switch is formed by a mechanical breaker that is on/off-controlled by the cam.

However, mechanical breakers are likely to be severely damaged by arc discharge and the like, and therefore have relatively short service lives and require many man-hours of check and maintenance.

SUMMARY OF THE INVENTION

Accordingly, it is an object of the invention to provide an internal combustion engine ignition apparatus that does not require an external power source and can easily be checked and maintained.

One aspect of the invention provides an ignition apparatus of an internal combustion engine including a generator that has a primary coil and a secondary coil and that generates an induced voltage in the secondary coil by using an induced current that flows through the primary coil based on rotation of an output shaft of the internal combustion engine, a device for generating the induced voltage in the secondary coil by discontinuing the induced current and for applying the induced voltage to an ignition plug of the internal combustion engine, a semiconductor switching element that controls one of discontinuation and conduction of a current through the primary coil, and an element drive signal generation device for generating a signal that switches the semiconductor switching element on and off based on the rotation of the output shaft. The element drive signal generation device generates an element drive signal so that the semiconductor switching element switches from an on-state to an off-state at a timing at which ignition of the ignition plug is to be performed.

Therefore, the above-described ignition apparatus generates a control current that switches the semiconductor switching element on and off based on rotation of the output shaft of the internal combustion engine. Hence, the ignition apparatus does not require an external power source for ignition control. Furthermore, since the signal that switches the semiconductor switching element on and off is generated based on revolution of the internal combustion engine, the ignition apparatus allows easy and reliable setting of ignition timing. Further, the ignition apparatus does not require an external power source or a special drive circuit, but requires only a simple circuit construction.

The semiconductor switching element may be a MOSFET. MOSFETs have smaller conduction resistance when in an on-state than other types of switching elements such as bipolar transistors. Therefore, a MOSFET switching element provides performance (small resistance) similar to that of a breaker at the time of conduction. The on-state and off-state (conductive state and non-conductive state) of a MOSFET can be established by increasing the gate-source voltage to or above a threshold voltage. Since the current consumption of a MOSFET is very small, the control thereof is very easy. Therefore, unlike bipolar transistors, the MOSFET switching element does not need conduction of a relatively large base current in accordance with the load current. Furthermore, the MOSFET switching element has a quicker response speed than bipolar transistors or the like. Hence, the operation timing of the MOSFET switching element can be set similarly to that of a conventional breaker.

The ignition apparatus according to the invention may further include a comparator that converts an analog signal generated by the element drive signal generation device, such as an electromagnetic pickup or the like, into a digital signal and that outputs an output signal that switches the conductor switching element on and off, and a comparator operating power source portion that is electrically charged by an induced current generated by rotation of an ignition power generating permanent magnet and that supplies the comparator with an operating power.

Therefore, a sine waveform signal generated by the element drive signal generation device, such as an electromagnetic pickup, is converted into a rectangular waveform signal, which is applied to the switching element. Therefore, the on/off operation of the switching element becomes similar to that of a mechanical breaker, so that the switching loss of the switching element can be considerably reduced. Furthermore, it is unnecessary to provide any special power source for the comparator.

The ignition apparatus may further include an external power source that supplies a current to the primary coil, and a second element drive signal generation device for, when the current from the external power source is supplied to the primary coil, generating a second element drive signal that controls switch on and off of the semiconductor switching element, independently of the element drive signal.

Therefore, it becomes possible to substantially freely control the ignition timing and optimally change the ignition timing in accordance with the operating condition of the internal combustion engine. For example, there normally is a requirement that the ignition timing be closer to the top dead center during start of the engine than during normal engine operation. This requirement can be achieved by using the second element drive signal. The ignition timing can also be changed during normal engine operation. If the second element drive signal is absent, normal ignition can be performed based on the voltage induced by the permanent magnet.

Another aspect of the invention provides an ignition apparatus of an internal combustion engine including a generator that has a primary coil and a secondary coil and that generates an induced voltage in the secondary coil by using an induced current that flows through the primary coil based on rotation of an output shaft of the internal combustion engine, a device for generating the induced voltage in the secondary coil by discontinuing the induced current and for applying the induced voltage to an ignition plug of the internal combustion engine, a semiconductor switching element that controls one of discontinuation and conduction of a current through the primary coil, an element switching-on signal generation device for generating a signal that switches the semiconductor switching element on based on the induced current through the primary coil, and an element switching-off signal generation device for generating a signal that switches the semiconductor switching element off based on the rotation of the output shaft. The element switching-on signal generation device and the element switching-off signal generation device generate an element drive signal so that the semiconductor switching element switches from an on-state to an off-state at a timing at which ignition of the ignition plug is to be performed.

This ignition apparatus according to the invention switches on the switching element by using the current induced through the primary coil, so that a predetermined current can be caused to flow through the primary coil at a necessary timing. The signal for switching the switching element off is generated by a second signal generation device that operates based on rotation of the output shaft. Therefore, the switching on of the switching element and the switching off of the switching element can be separately set, thereby increasing the freedom in the timing setting. Hence, the switching element can be switched on and off at appropriate timings.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the invention will be described hereinafter with reference to the accompanying drawings.

Figure 1:
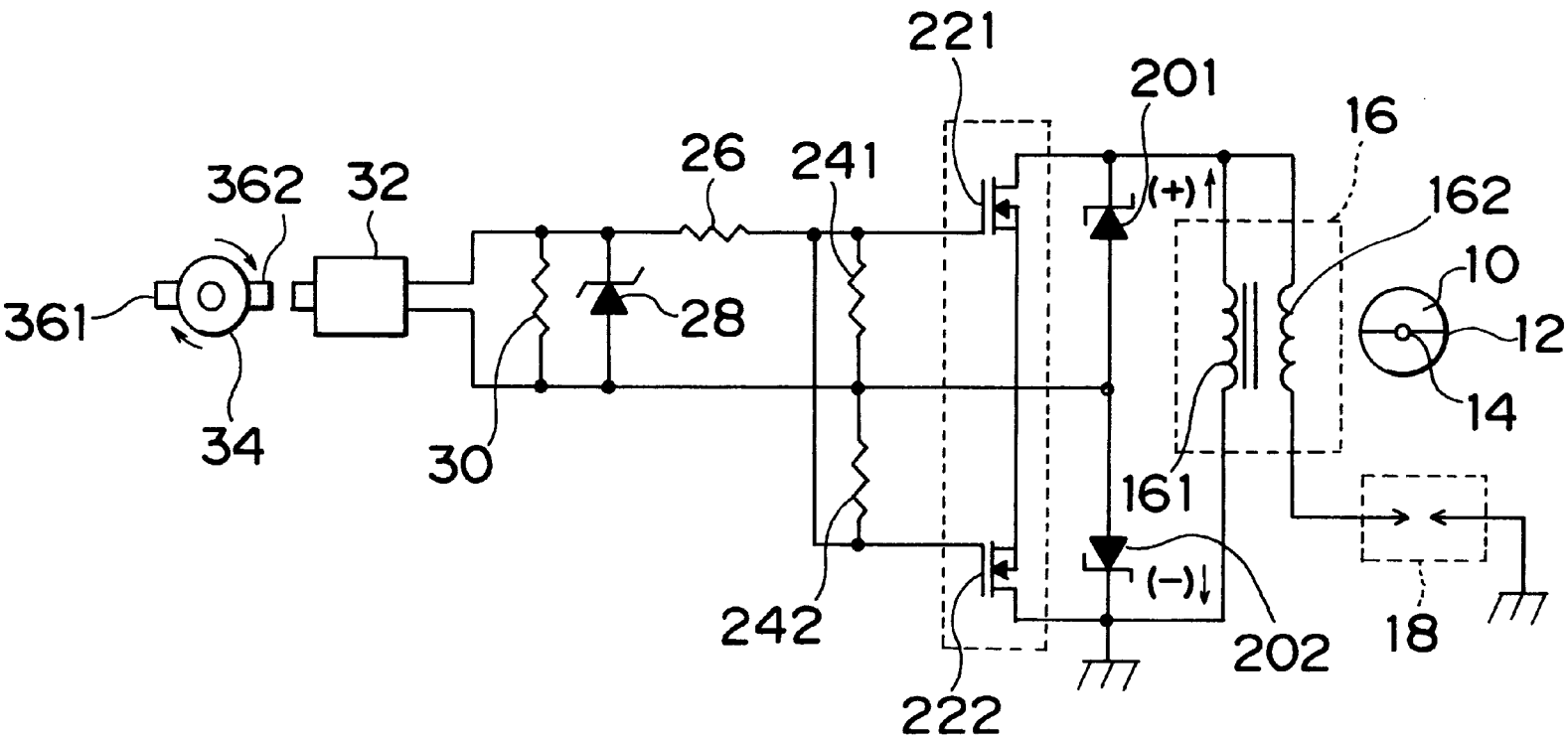
FIG. 1 is an illustration of a construction of a first embodiment of the invention.

FIG. 1 illustrates a construction of a first embodiment of the ignition apparatus of the invention. A rotating disc 12 formed by a permanent magnet 10 is fixed to a magneto shaft 14 that is a rotating output shaft of an internal combustion engine (not shown). A primary coil 161 of an ignition coil device 16 is disposed near the rotating disc 12. As the permanent magnet 10 (i.e., a permanent magnet for generating ignition power) moves, current is induced through the primary coil 161, that is, magneto electromotive force, is created.

A secondary coil 162 is disposed corresponding to the primary coil 161, with an iron core disposed therebetween. An end (lower end in FIG. 1) of the secondary coil 162 is connected to an ignition plug 18. The other end of the ignition plug 18 is grounded. Therefore, a voltage induced across the secondary coil 162 is applied to the ignition plug 18.

The other end (upper end in FIG. 1) of the primary coil 161 and the end of the secondary coil 162 opposite from the end thereof connected to the ignition plug 18 (i.e., the upper end of the secondary coil 162 in FIG. 1) are interconnected.

The lower end of the primary coil 161 is grounded. Two diodes 201 and 202 are connected in series between the upper and lower ends of the primary coil 161. The upper diode 201 is connected at its cathode to the upper end of the primary coil 161. The lower diode 202 is connected at its cathode to the lower end of the primary coil 161. The diodes 201, 202 are interconnected at their anodes.

Two switching elements 221, 222 are connected in series between the upper and lower ends of the primary coil 161. The switching elements 221, 222 are each formed by an N-channel MOSFET. An intermediate point between the diodes 201, 202 and an intermediate point between the switching elements 221, 222 are interconnected, so that the source and the drain of the switching element 221 are interconnected by the diode 201 and the source and drain of the switching element 222 are interconnected by the diode 202.

Resistors 241, 242 are connected in series between the gates of the switching elements 221, 222. An intermediate point between the resistors 241, 242 is connected to an intermediate point between the switching elements 221, 222. Furthermore, the gates of the switching elements 221, 222 are short circuited.

The upper end of the resistor 241 is connected, via a resistor 26, to the cathode of a diode 28, the upper end of a resistor 30, and an end of an electromagnetic pickup 32 that serves as an element drive signal generating device. The anode of the diode 28, the lower end of the resistor 30 and the other end of the electromagnetic pickup 32 are connected to the lower end of the resistor 241. A rotating disc 34 connected to an output shaft of the engine is disposed near the electromagnetic pickup 32. The rotating disc 34 is formed from a magnetic material, and has a pair of protrusions 361, 362.

Figure 2:
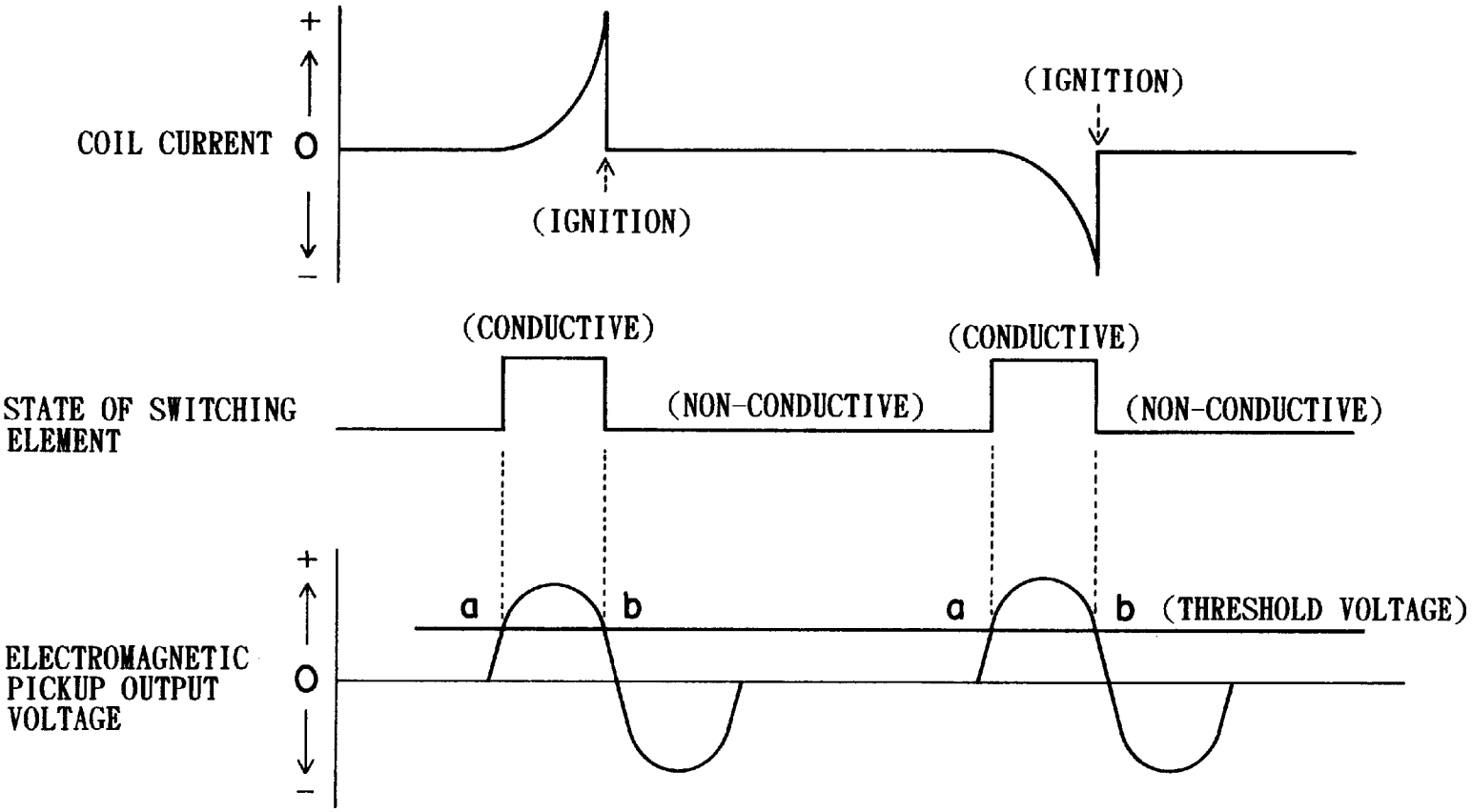
FIG. 2 indicates the output voltage of an electromagnetic pickup, and the operation of a switching element.

Therefore, as the magneto shaft 14 rotates, the protrusions 361, 362 of the rotating disc 34 pass through a vicinity of the electromagnetic pickup 32, so that voltage is induced in the electromagnetic pickup 32. The output voltage of the electromagnetic pickup 32 has a sine waveform as indicated at a bottom in FIG. 2.

Figure 3:
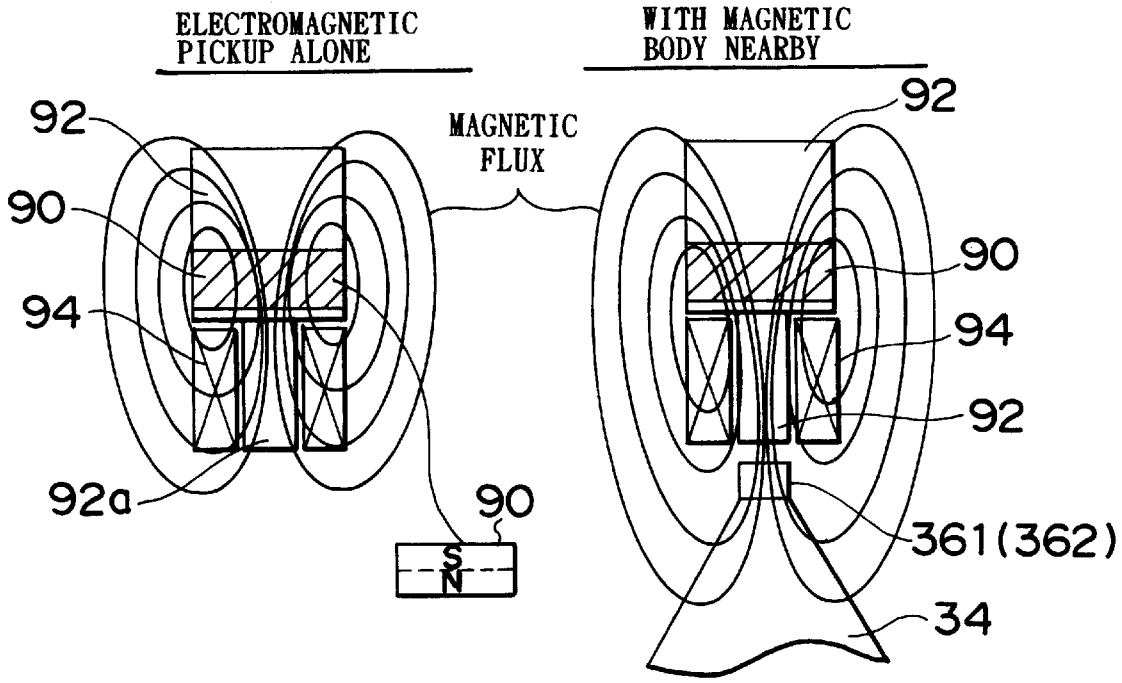
FIG. 3 is an illustration of a construction of the electromagnetic pickup.
Figure 4:
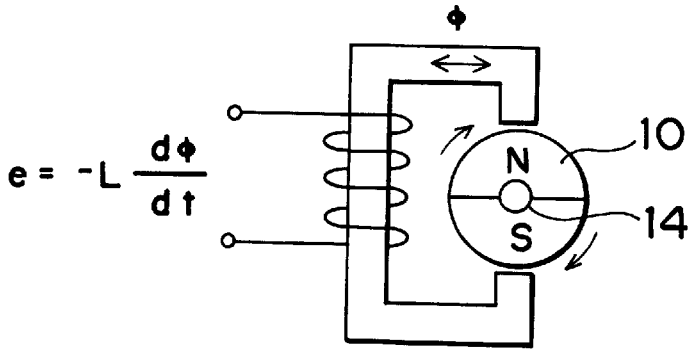
FIG. 4 is a conceptual diagram of magneto power generation.

As shown in FIG. 3, the electromagnetic pickup 32 is substantially made up of a permanent magnet 90, a core 92 that guides magnetic flux of the permanent magnet 90, and a coil 94 wound on a small-diameter portion 92*a* of the core 92. As indicated, the permanent magnet 90 is disposed in a posture in which the magnetic poles thereof are arranged vertically in FIG. 3.

The rotating disc 34 is disposed facing a distal end of the small-diameter portion 92*a* of the core 92. During rotation of the rotating disc 34, the protrusions 361, 362 alternately move closer to and away from the distal end of the small-diameter portion 92*a*. When the protrusion 361 or 362 approaches the distal end of the small-diameter portion 92*a*, the magnetic flux of the permanent magnet 90 is drawn toward the small-diameter portion 92*a* so that the amount of magnetic flux extending through the coil 94 increases.

Current flows through the coil 94 in accordance with changes in the magnetic flux. When the protrusion 361 or 362 moves closer to the coil 94, current flows through the coil 94 in one direction. When the protrusion 361 or 362 moves away from the coil 94, current flows through the coil 94 in the opposite direction. When the protrusion 361 or 362 is at a closest position to the small-diameter portion 92*a*, the current through the coil 94 becomes zero. In an example indicated in FIG. 2, current flows through the coil 94 in the positive direction when the protrusion 361 or 362 moves closer to the small-diameter portion 92*a*, and current flows in the negative direction when the protrusion 361 or 362 moves away from the small-diameter portion 92*a*.

The output voltage of the electromagnetic pickup 32 is basically applied to the gates of the switching elements 221, 222. Each switching element 221, 222 switches on (becomes conductive) when the gate voltage becomes higher than the source voltage by at least a predetermined amount (a threshold voltage, e.g., 5 V). Therefore, as indicated in the intermediate diagram in FIG. 2, the switching elements 221, 222 become conductive when the output voltage of the electromagnetic pickup 32 becomes equal to or greater than the threshold voltage (in a region of point a to point b in FIG. 2). Since the rotating disc 34 has two protrusions 361, 362, the electromagnetic pickup 32 outputs sine waves having a period that corresponds to a half rotation of the magneto shaft 14. Therefore, the switching elements 221, 222 turn on twice per rotation of the magneto shaft 14. The current through the primary coil 161 gradually increases after the switching elements 221, 222 turn on, as indicated in the top diagram in FIG. 2. In the moment that the switching elements 221, 222 turn off, the current through the primary coil 161 becomes to zero again. Thus, the on-timing of the switching elements 221, 222 is an ignition timing of the ignition plug 18.

The resistor 30 is provided to stabilize an output signal of the electromagnetic pickup 32 so as to prevent the output signal from interfering with the input capacitance of each switching element 221, 222. The diode 28 is provided to protect the switching elements 221, 222 from over voltages of the output signal from the electromagnetic pickup 32. The voltage across the diode 28 is normally set to about 10 V. Therefore, the voltage across the diode 28 does not exceed 10 V, so that the gate-source voltage of the switching elements 221, 222 does not exceed 10 V.

The diode 28 also cuts output voltages of the electromagnetic pickup 32 in one direction, so as to prevent the gate potential of the switching elements 221, 222 from becoming lower than the source potential (i.e., prevent reverse voltage between the gate and the source of each switching element 221, 222). More specifically, the diode 28 eliminates negative voltages from the output voltages of the electromagnetic pickup 32 indicated in the bottom diagram in FIG. 2. The resistor 26 is provided to limit the current at the time of turning on the switching elements 221, 222.

The permanent magnet 10 has two poles, that is, an N-pole and an S-pole, and rotates as the magneto shaft 14 rotates. A magnetic circuit including a core is formed outside the permanent magnet 10 so that the magnetic flux produced by the permanent magnet 10 intersects with a coil via the core. Therefore,as the permanent magnet 10 rotates, the magnetic flux $\phi$ intersecting with the coil changes, so that an electromotive force e proportional to the change of the magnetic flux $\phi$ is induced in the coil. The induced electromotive force e can be expressed as $e=-L d\phi/dt$ where L is the inductance of the magnetic circuit.

Figure 5:
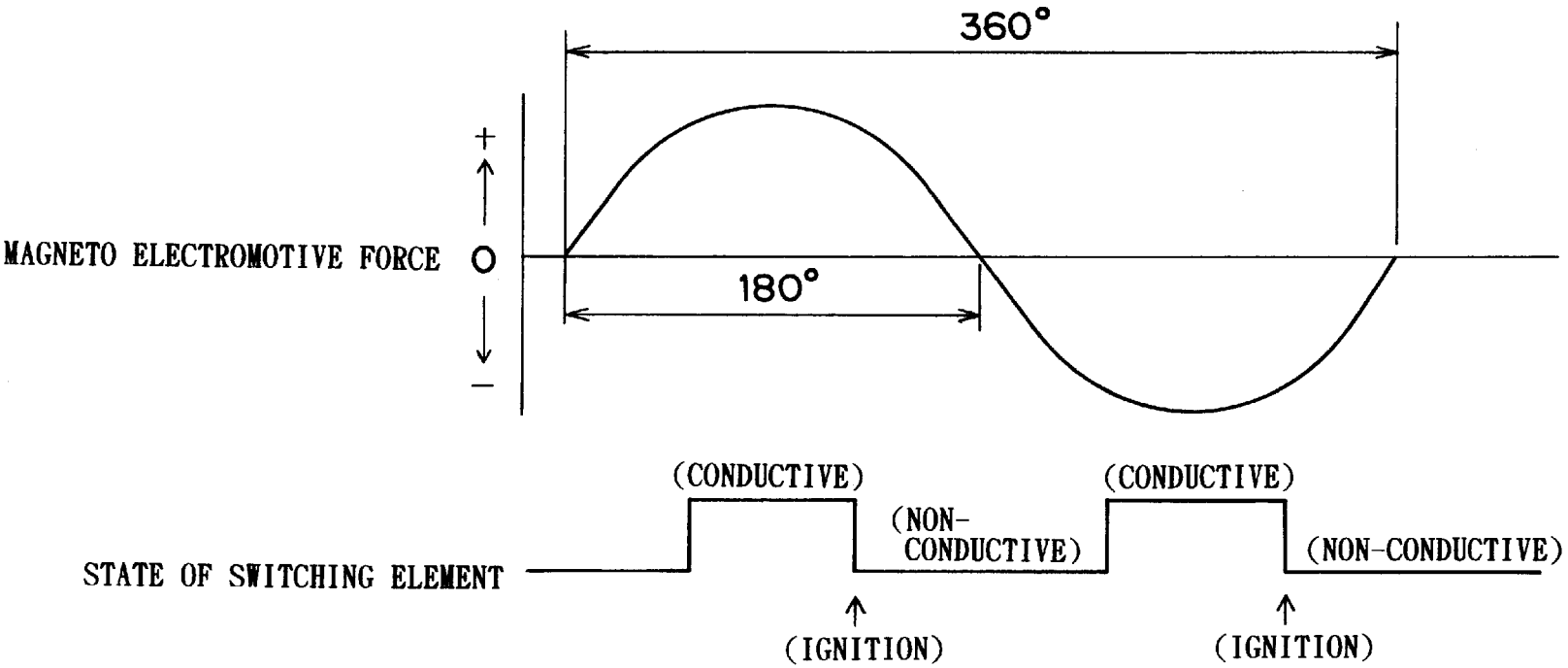
FIG. 5 indicates a relationship between the magneto electromotive force and the operation of the switching element.

In this embodiment, the permanent magnet 10 has a single N-pole and a single S-pole. Therefore, as the permanent magnet 10 rotates, current is induced through the primary coil 161 as indicated in FIG. 5. That is, magneto electromotive forces having a sine waveform with a period equal to one rotation (360°) of the permanent magnet 10 are created in the primary coil 161. In this embodiment, when the magneto electromotive force is positive (+), positive voltages are outputted from the upper end of the primary coil 161. When the magneto electromotive force is negative (−), negative voltages are outputted from the lower end of the primary coil 161.

If the internal combustion engine is a 4-cylinder 4-stroke engine, ignition needs to be performed twice (in two cylinders) per engine revolution. In each cylinder, ignition is performed at, for example, a timing that is 20–25° advanced from the top dead center of the piston. Therefore, the switch-off timing of the switching elements 221, 222 is set so as to apply a great voltage to each ignition plug at the aforementioned ignition timing.

When the output voltage of the electromagnetic pickup 32 exceeds the threshold voltage, current flows through the primary coil 161 of the ignition coil device 16. In the moment that the output voltage of the electromagnetic pickup 32 becomes smaller than the threshold voltage, the switching element 221 or 222 switches off. When the output voltage of the electromagnetic pickup 32 is in the positive direction, the switching element 221 operates as a current cutoff switch. When the output voltage is in the negative direction, the switching element 222 operates as a current cutoff switch.

Therefore, at the time point when the output voltage of the electromagnetic pickup 32 becomes less than the threshold voltage, the current through the primary coil 161 of the ignition coil device 16 is sharply cut off. This sharp current change in the primary coil 161 induces a great voltage in the secondary coil 162. The great voltage is then applied to the ignition plug 18 to perform ignition.

Although FIG. 1 shows only one ignition plug 18, it should be apparent that if the engine has, for example, four cylinders, four ignition plugs are provided, and sequentially receive the ignition voltage. Considering the ignition timing, the characteristic of current to the primary coil 161 is preset so that the energy of electrification of the primary coil 161 becomes maximum at a required timing.

The diodes 201, 202 are provided to limit an increase in voltage caused by self-induction occurring when the current through the primary coil 161 is cut off. Furthermore, when the switching element 221, 222 is on, the diode 202 allows currents based on positive (+) voltages, and the diode 201 allows currents based on negative (−) voltages.

In this embodiment, the rotating disc 34 having two protrusions 361, 362 is fixed to the magneto shaft 14 in order to produce control currents that switch the switching elements 221, 222 on and off. Therefore, the embodiment does not need an external power source for ignition control. Furthermore, since the signals for switching the switching elements 221, 222 on and off are generated on the basis of rotations of the magneto shaft 14 driven by the engine, the ignition timing can easily and reliably be set.

The switching elements used in this embodiment are MOSFETs. MOSFETs have smaller conduction resistance when in the on-state than other switching elements such as bipolar transistors or the like. Therefore, MOSFETs provide performance (small resistance) similar to that of a breaker at the time of conduction. The on-state and off-state (conductive state and non-conductive state) of the MOSFET switching elements in the embodiment can be established by increasing the gate-source voltage to or above the threshold voltage. Therefore, the current consumption is very small, so that the control thereof is very easy. Therefore, unlike bipolar transistors, the MOSFET switching elements in this embodiment do not need conduction of a relatively large base current in accordance with the load current. Furthermore, the MOSFET switching elements in this embodiment have a quicker response speed than bipolar transistors or the like.

As a result, the operating timing of the switching elements in this embodiment can be set to a timing similar to that of a conventional breaker. Furthermore, since the electromagnetic pickup 32 is caused to produce signal voltages by the rotating disc 34 having the protrusions 361, 362 and fixed to the magneto shaft 14, the embodiment does not require an external power source or a special drive circuit, but requires only a simple circuit construction.

Figure 6:
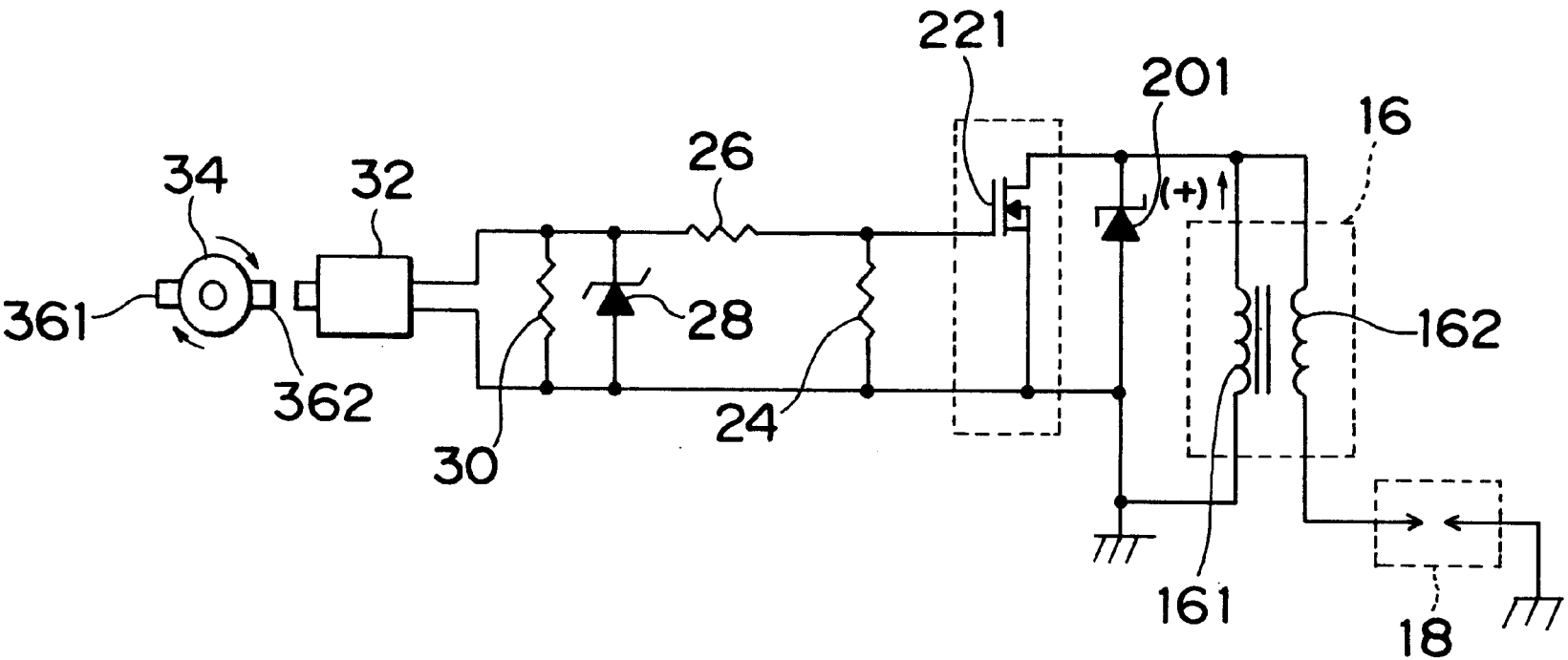
FIG. 6 is an illustration of a construction of a second embodiment of the invention.
Figure 7:
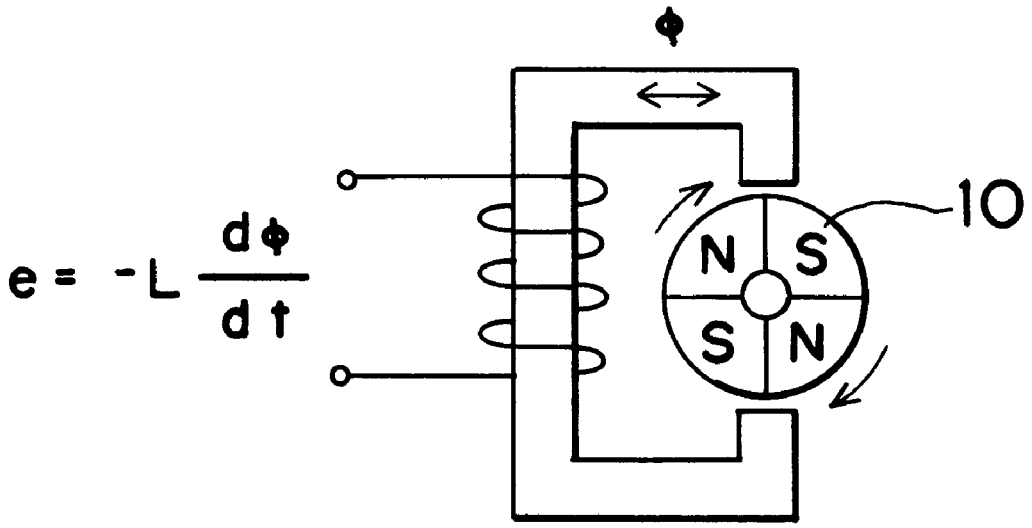
FIG. 7 is a conceptual diagram of magneto power generation according to the second embodiment.

FIG. 6 illustrates a construction of a second embodiment of the invention, wherein a permanent magnet 10 is omitted from the illustration. This embodiment does not employ a switching element 222, and therefore does not have a diode 202 nor a resistance 242. The permanent magnet 10 fixed to a magneto shaft 14 has four poles (N, S, N, S) as indicated in FIG. 7. Therefore, each rotation of the magneto shaft 14 induces, in a primary coil 161, currents having two periods (720°) per rotation of the magneto shaft 14.

Figure 8:
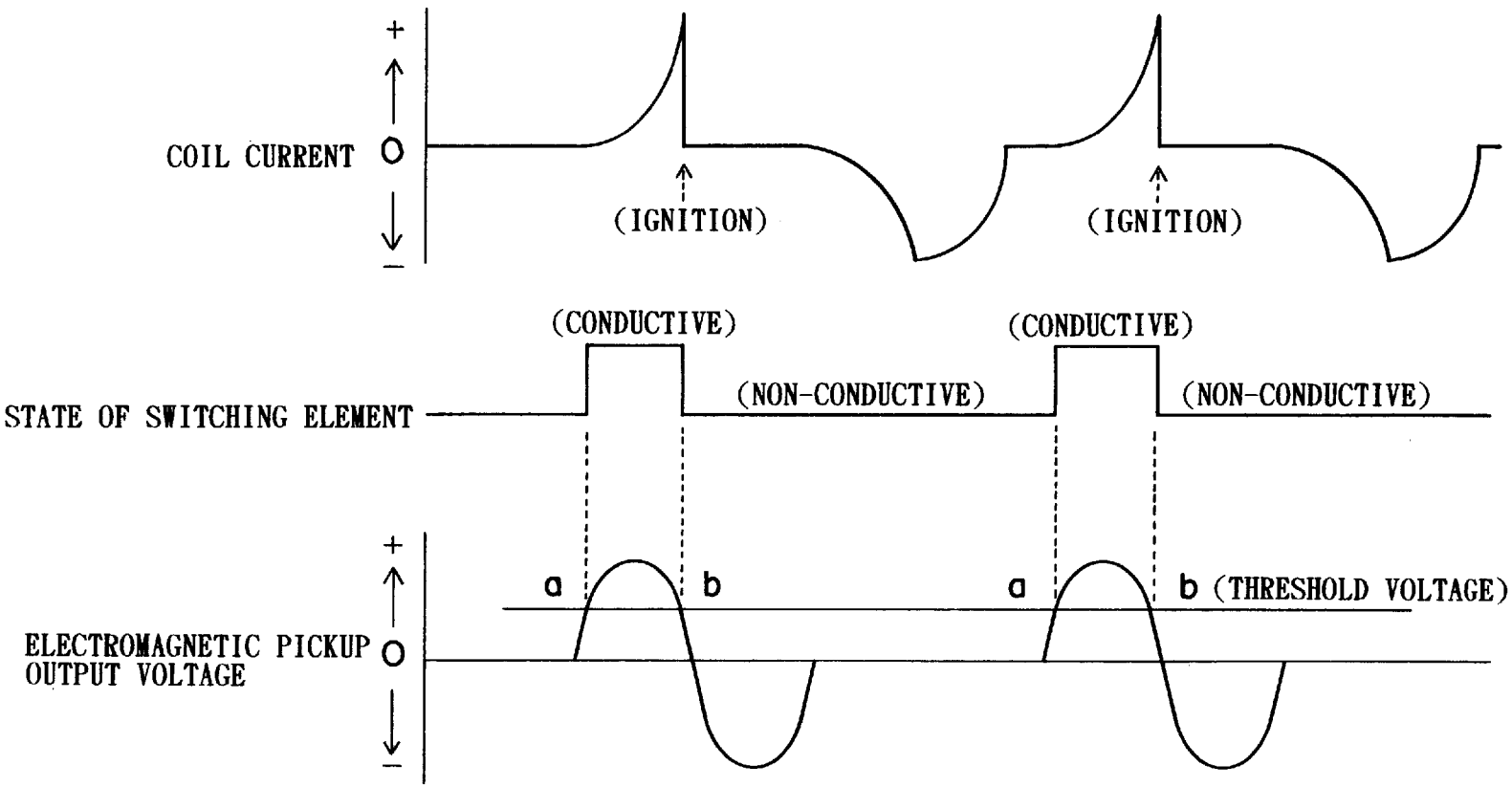
FIG. 8 indicates the output voltage of an electromagnetic pickup, and the operation of a switching element.

A rotating disc 34 and its protrusions 361, 362 are substantially the same as those in the first embodiment. The output voltage of an electromagnetic pickup 32 and the switch-on timing of a switching element 221 are basically the same as those in the first embodiment, as indicated in FIG. 8.

Therefore, the switching element 221 switches on only while voltage is occurring in a positive (+) direction in the primary coil 161. Hence, as indicated in a top diagram in FIG. 8, the primary coil 161 produces currents alternately in the positive (+) and negative (−) directions. In this embodiment, too, great voltage is induced in the secondary coil 162 by the switching element 221 switching off synchronously with the ignition timing. The induced great voltage is applied to an ignition plug 18.

The second embodiment constructed as described above achieves substantially the same advantages as achieved by the first embodiment. In the second embodiment in particular, the current occurring at the ignition timing is solely in the positive direction, so that the circuit construction of the switching element can be simplified. Negative current is clamped by the diode 201.

Figure 9:
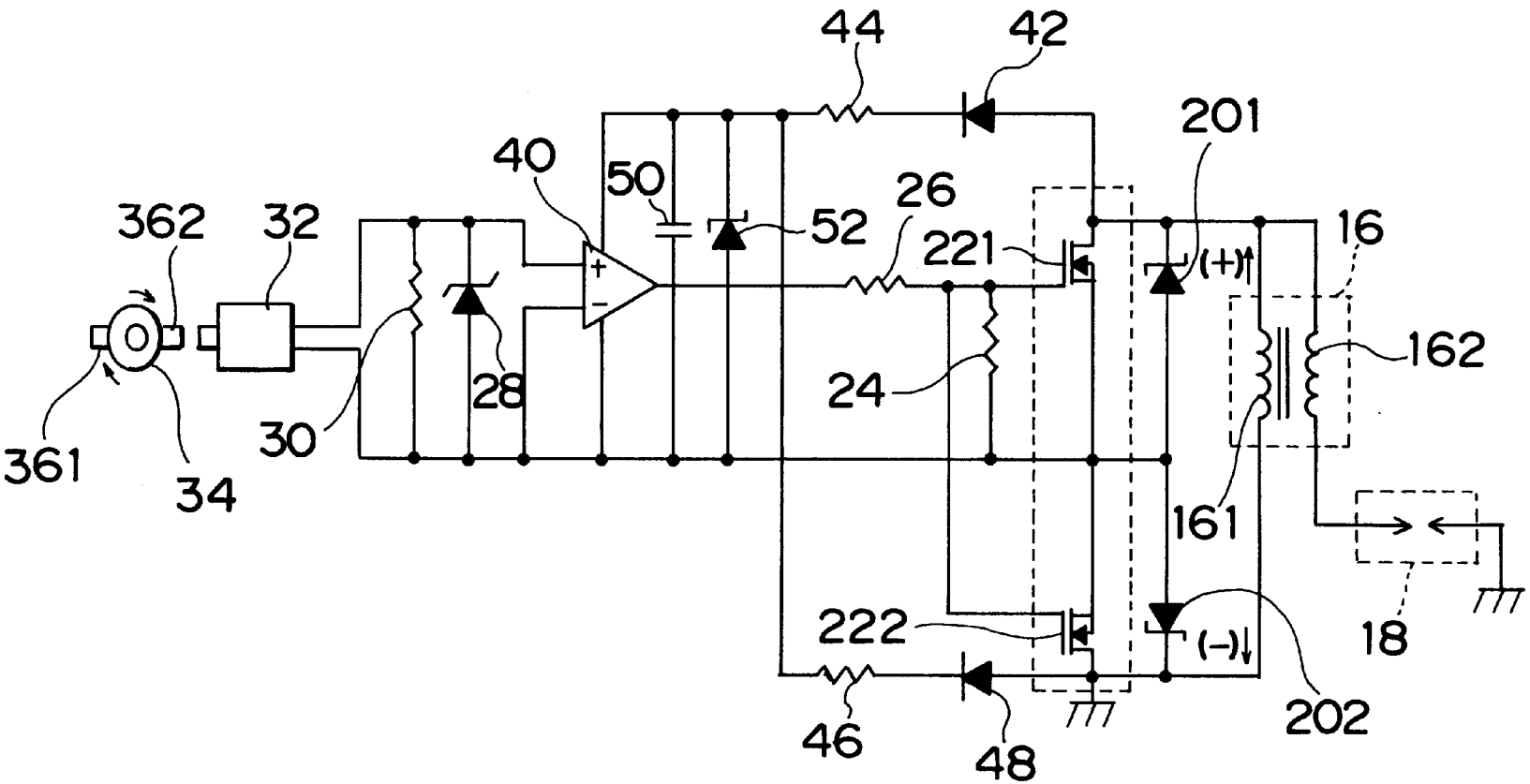
FIG. 9 is an illustration of a construction of a third embodiment of the invention.

FIG. 9 illustrates a construction of a third embodiment of the invention. An ignition apparatus of the third embodiment has a voltage comparator 40. In the third embodiment, the power for operating the voltage comparator 40 is supplied from a primary coil 161. A permanent magnet 10 is omitted from the illustration of FIG. 9.

Both ends of an electromagnetic pickup 32 are connected to inputs of the voltage comparator 40, via a resistor 30 and a diode 28. An output of the voltage comparator 40 is applied to the gate of each switching element 221, 222, via a resistor 26. The resistors 241, 242 in the first embodiment are simply connected in parallel. In the third embodiment, the parallelly connected resistors are replaced by a single resistor 24.

An upper terminal of the primary coil 161 is connected to the anode of a diode 42. The cathode of the diode 42 is connected to the power-side input end of the voltage comparator 40 via a resistor 44. The power-side end of the voltage comparator 40 is connected to the cathode of a diode 48 via a resistor 46. The anode of the diode 48 is grounded. The ground-side end of the voltage comparator 40 is connected to a negative input end of the voltage comparator 40, and connected to the source of the switching element 222 via a diode 202. A capacitor 50 and a diode 52 are connected between the power-side input end and the ground-side end of the voltage comparator 40. The anode of the diode 52 is connected to the ground-side end of the voltage comparator 40, and the cathode of the diode 52 is connected to the power-side input end of the voltage comparator 40.

Therefore, when voltage occurs in a positive (+) direction in the primary coil 161, the positive voltage is inputted to the diode 52 via the diode 42 and the resistor 44. When voltage occurs in the negative (−) direction in the primary coil 161, the negative voltage is inputted to the capacitor 50 via the diode 48 and the resistor 46. The diodes 42, 48 are provided for preventing a decrease of the upper end potential of the capacitor 50 (the power source potential of the voltage comparator 40). The diode 52 keeps the upper end potential of the voltage comparator 40 below a predetermined potential (the operation upper limit voltage of the voltage comparator 40). As a result, a predetermined amount of charges is stored into the capacitor 50 due to currents induced through the primary coil 161 by rotation of the permanent magnet 10. The amount of charges stored in the capacitor 50 is used as a power for operating the voltage comparator 40.

Figure 10:
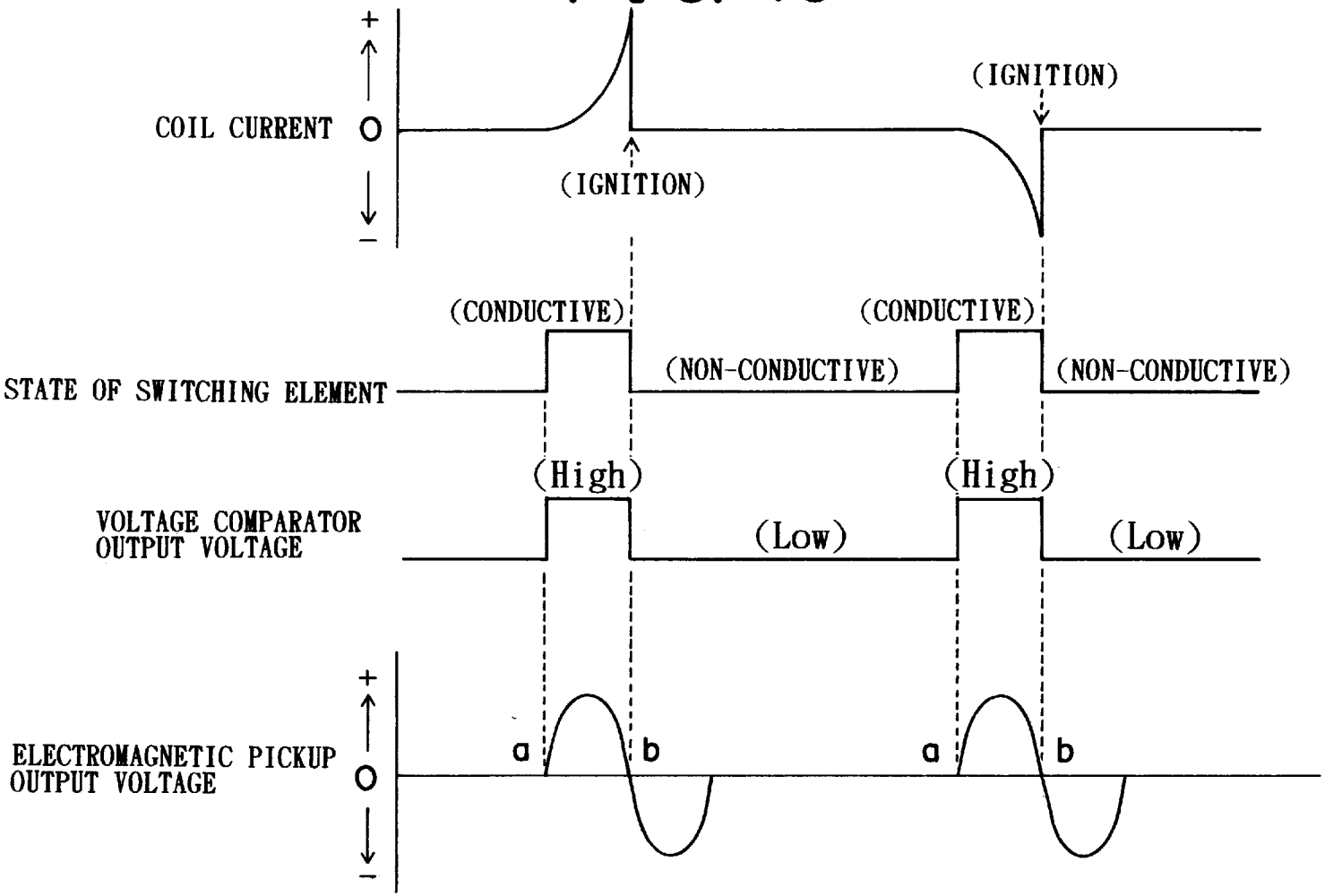
FIG. 10 indicates the output voltage of an electromagnetic pickup, and the operation of a switching element.

The voltage comparator 40 compares the output from the electromagnetic pickup 32 with the voltage occurring at the negative input end of the voltage comparator 40. When a voltage greater than the level at the negative input is applied to the positive input of the voltage comparator 40, the voltage comparator 40 outputs a high(H)-level signal. As can be seen from FIG. 10, the sine waveform of output of the electromagnetic pickup 32 is converted into a rectangular waveform of output of the voltage comparator 40 in which the output becomes the H-level only when the output of the electromagnetic pickup 32 is higher than 0 V. The output of the voltage comparator 40 having the rectangular waveform is applied to the switching elements 221, 222. Therefore, the switching elements 221, 222 are on when the rectangular waveform output of the voltage comparator 40 is at the H-level. The switching elements 221, 222 are off when the output of the voltage comparator 40 is at the L-level. The switching elements 221, 222 switch on and off instantly at every rise and fall of the rectangular waveform output. Therefore, the switching on/off operation of the switching elements 221, 222 accomplishes a function similar to that of a mechanical breaker.

The switching-off timing of the switching elements 221, 222 is adjusted in accordance with the ignition timing.

The circuit construction of the third embodiment also achieves substantially the same advantages as achieved by the foregoing embodiments.

Figure 11:
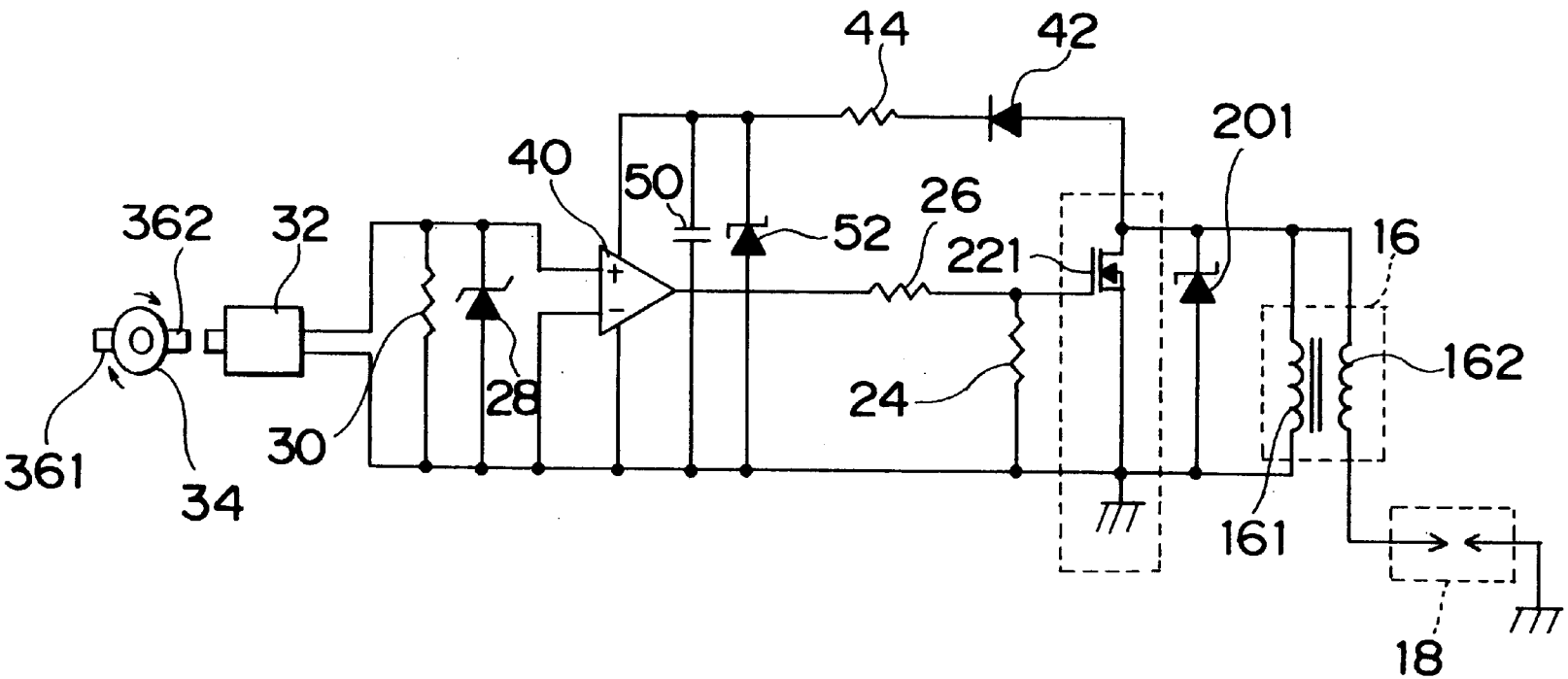
FIG. 11 is an illustration of a construction of a fourth embodiment of the invention.

FIG. 11 illustrates a construction of a fourth embodiment of the invention. The construction of the fourth embodiment is obtained by adding the voltage comparator 40 of the third embodiment and a power circuit for operating the voltage comparator 40 to the construction of the second embodiment. The fourth embodiment also achieves substantially the same advantages as achieved by the foregoing embodiments.

Figure 12:
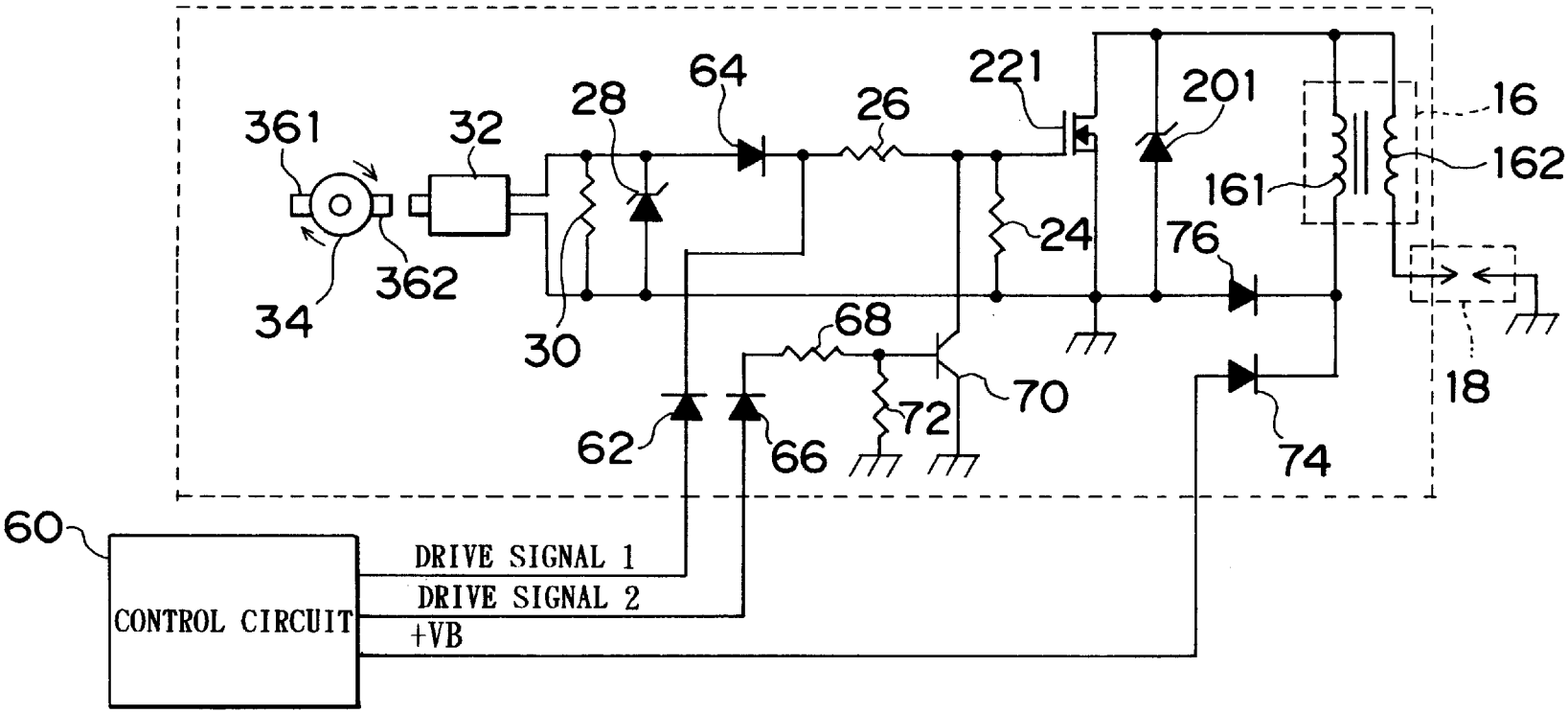
FIG. 12 is an illustration of a construction of a fifth embodiment of the invention.

FIG. 12 illustrates a construction of a fifth embodiment of the invention. The ignition apparatus of the fifth embodiment is able to perform ignition by using a drive signal from an external device as well. As shown in FIG. 12, the construction of the fifth embodiment has a control circuit 60 that operates as a second element drive signal generating device. The control circuit 60 operates by using an external power source, and outputs a drive signal 1, a drive signal 2 and a power source voltage +VB. A permanent magnet 10 is omitted from the illustration of FIG. 12.

The line of the drive signal 1 is connected to an electromagnetic pickup 32-connected end of a resistor 26, via a diode 62. Therefore, the drive signal 1 is applied to the gate of a switching element 221 via the resistor 26. A diode 64 is disposed at an electromagnetic pickup-side of a point where the drive signal 1 is inputted (that is, a cathode-side of a diode 28), so as to prevent input of the drive signal 1 to the electromagnetic pickup-side.

The line of the drive signal 2 is connected to the base of a transistor 70 via a diode 66 and a resistor 68. The transistor 70 is an NPN transistor. The collector of the transistor 70 is connected to the gate of the switching element 221, and the emitter of the transistor 70 is grounded. The base of the transistor 70 is also connected to one end of a resistor 72. The other end of the resistor 72 is grounded. Therefore, the transistor 70 is switched on and off by using the drive signal 2 so as to control the gate voltage of the switching element 221. Since the resistor 72 is grounded, the transistor 70 remains off unless the drive signal 2 is changed to an H-level.

The power source voltage +VB is inputted to a lower end of a primary coil 161 via a diode 74. A diode 76 is connected between the lower end of the primary coil 161 and the ground (the anode of a diode 201). The diode 76 is directed so that the cathode thereof is connected to the primary coil 161. Thus, the diode 76 prevents the power source voltage +VB from causing a current toward the ground.

In the construction described above, the control circuit 60 controls ignition of the ignition plug 18 at the time of start of the engine. That is, when the engine is started, the control circuit 60 supplies the power source voltage +VB to the primary coil 161 from its lower end, and controls the switching element 221 by using the drive signal 1. The signal from the electromagnetic pickup 32 and the drive signal 2 are irrelevant to this operation.

Figure 13:
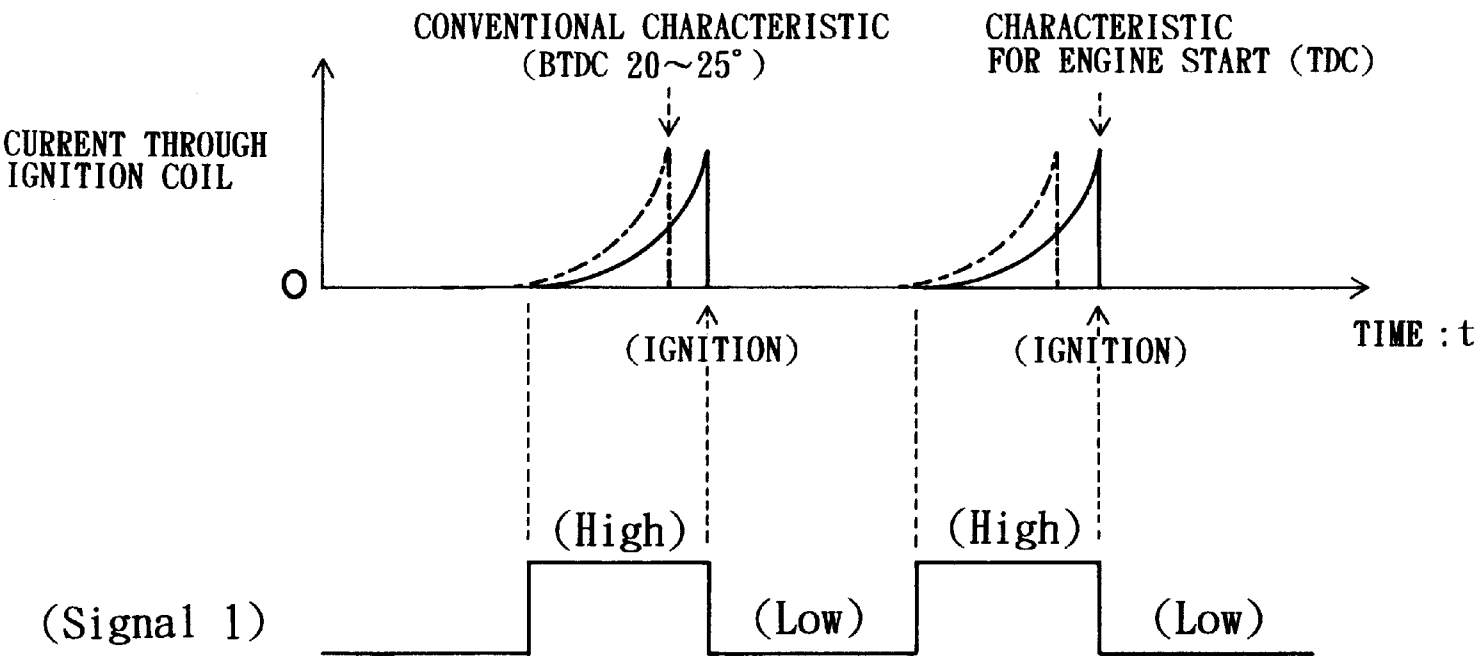
FIG. 13 is a chart indicating ignition timing during start of an engine.

When the engine is started, the drive signal 1 is changed to a high level so as to switch on the switching element 221 at a predetermined time before the ignition timing, as indicated in FIG. 13. Therefore, current flows through the primary coil 161 in a positive (+) direction. The switching element 221 is then switched off by changing the drive signal 1 to a low level, so that the current through the primary coil 161 is discontinued. In response, great voltage is induced in the secondary coil 162, and is applied to the ignition plug 18.

Therefore, high voltage can be applied to the ignition plug 18 at an arbitrary timing by using the drive signal 1. Since the ignition plug 18 can be controlled by using the power source voltage +VB and the drive signal 1 from the control circuit 60, the embodiment is able to appropriately control the ignition timing at the time of start of the engine. Particularly at the time of start of the engine, the engine revolution speed is low. Therefore, considering the combustion speed and the like, the ignition timing needs to be set near the compression top dead center (TDC) in each cylinder at the time of start of the engine. Hence, it is inappropriate to immediately adopt the ignition timing used in an ordinary magneto ignition apparatus (that is, 20–25° before the compression top dead center). Therefore, in conventional arts, a device that operates only at the time of start of the engine, such as a starting vibrator or the like, is separately provided. This embodiment delays the ignition timing during start of the engine from a timing that is set during normal operation of the engine, by using the drive signal 1, as indicated in FIG. 13. In this manner, the embodiment is able to favorably control the engine ignition during start of the engine. Other operations needed to start the engine are omitted from the description in this specification.

During normal operation of the engine, the ignition apparatus of the embodiment switches the switching elements 221, 222 on and off to control ignition on the basis of the signal generated by the protrusions 361, 362 of the rotating disc 34, as in the apparatuses of the foregoing embodiments.

Figure 14:
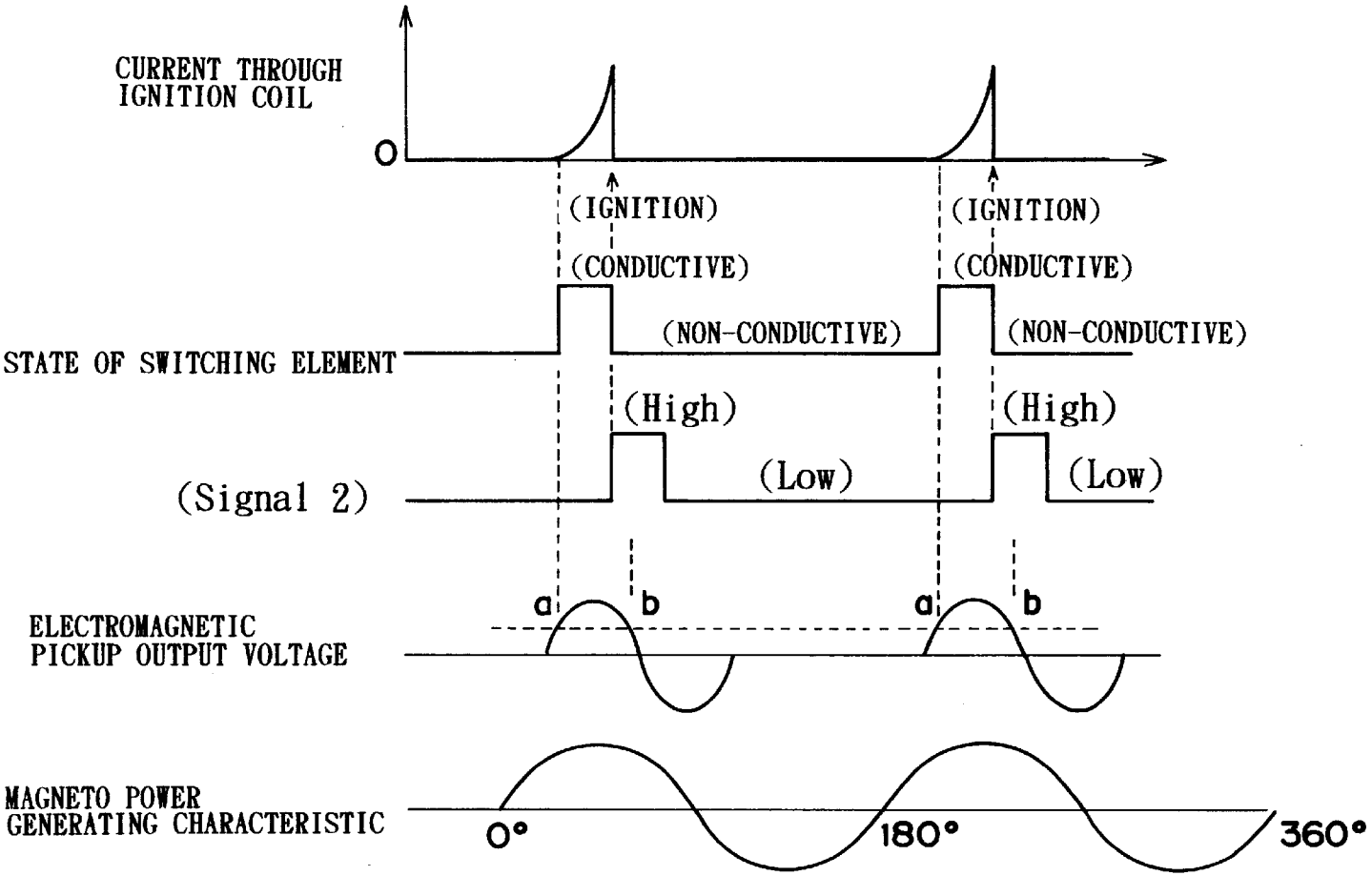
FIG. 14 is a chart indicating ignition timing.

Furthermore, the ignition apparatus of this embodiment is able to turn the transistor 70 on and off by using the drive signal 2. More specifically, by turning the transistor 70 on, the switching element 221 is switched off. Therefore, the ignition apparatus is able to switch the switching element 221 off at a timing at which the signal from the electromagnetic pickup 32 is at the high level, as indicated in FIG. 14. Therefore, the ignition timing can be adjusted by using the drive signal 2 from the control circuit 60. Even if the drive signal 2 is not outputted due to a failure or the like, the ignition of the ignition plug 18 can still be performed by using the signal from the electromagnetic pickup 32.

Aircrafts are required to meet various requirements for aircraft authentication. A regulation regarding the power system requires that the engine of an aircraft be designed separately from the aircraft body so that if the aircraft body-side power should fail, the engine operation will not be affected. Magneto ignition apparatuses operate without requiring an external power source, so that the magneto ignition apparatuses meet the requirements. Therefore, use of a magneto ignition apparatus as an ignition apparatus of a small-side aircraft has become a mainstream technology.

Although the embodiment adopts the control circuit 60 driven by an external power source, the ignition apparatus is able to perform ignition by using the signal from the electromagnetic pickup 32 if the control circuit 60 is not provided. Therefore, omission of the control circuit 60 poses no problem in obtaining aircraft authentication.

The ignition apparatus is able to substantially freely adjust the ignition timing by using the signals from the control circuit 60. Therefore, the ignition timing can be set near the compression top dead center at the time of start of the engine, so that the engine starting characteristic improves.

When the engine revolution speed is low, for example, at the time of start of the engine, the amount of power generated by a magneto power generator is small so that the ignition quality is low. However, if an external power source is used, it becomes possible to supply a great amount energy for ignition during start of the engine, so that the engine starting characteristic improves.

In a practical engine speed range, no consideration is needed for the ignition timing setting for the start of the engine, so that the ignition timing can be controlled with a priority given to the engine operation efficiency and, therefore, operation at an optimal efficiency can be performed. Even if the external control circuit fails, the ignition apparatus is able to control the ignition independently of an external circuit as in an ordinary magneto ignition apparatus, by cutting off the signals supplied from the control signal.

Figure 15:
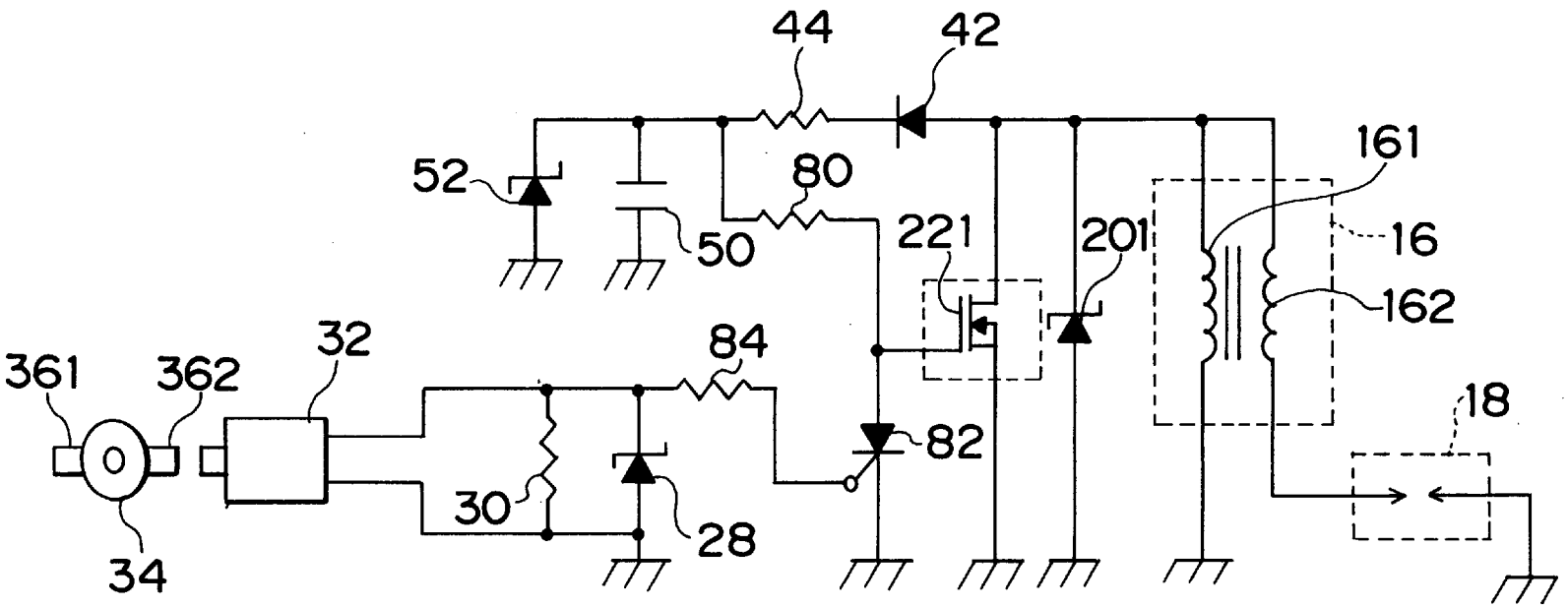
FIG. 15 is an illustration of a construction of a sixth embodiment of the invention.

FIG. 15 illustrates a construction of a sixth embodiment of the invention. In this embodiment, the voltage needed to switch a switching element on, through magneto power generation. The switching element is switched off by using an output signal of an electromagnetic pickup.

An arrangement of an ignition coil device 16, an ignition plug 18, a diode 201 and a switching element 221 is substantially the same as that of the second embodiment shown in FIG. 6 or that of the fourth embodiment shown in FIG. 11. An upper end of a primary coil 161 and an upper end of a secondary coil 162 are connected to an upper end of a capacitor 50 and an upper end of a diode 52, via a diode 42 and a resistor 44. The lower ends of the capacitor 50 and the diode 52 are grounded. This circuit construction is substantially the same as that of the fourth embodiment shown in FIG. 11. Therefore, power generated in the ignition coil device 16 is stored into the capacitor 50.

The upper end of the capacitor 50 is connected to the gate of the switching element 221 via a resistor 80. Therefore, an output voltage (magneto-generated voltage) from the ignition coil device 16 stored in the capacitor 50 is applied to the gate of the switching element 221.

The gate of the switching element 221 is also connected to the anode of a thyristor 82. The cathode of the thyristor 82 is grounded.

A resistor 30 and a diode 28 are connected between the two ends of an electromagnetic pickup 32. The lower end of the arrangement including the electromagnetic pickup 32 is grounded The upper end of the electromagnetic pickup 32 outputs sine waves as the protrusions 361, 362 of a rotating disc 34 move closer to and away from the electromagnetic pickup 32. The output signal from the electromagnetic pickup 32 is applied to the gate of the thyristor 82, via a resistor 84.

Figure 16:
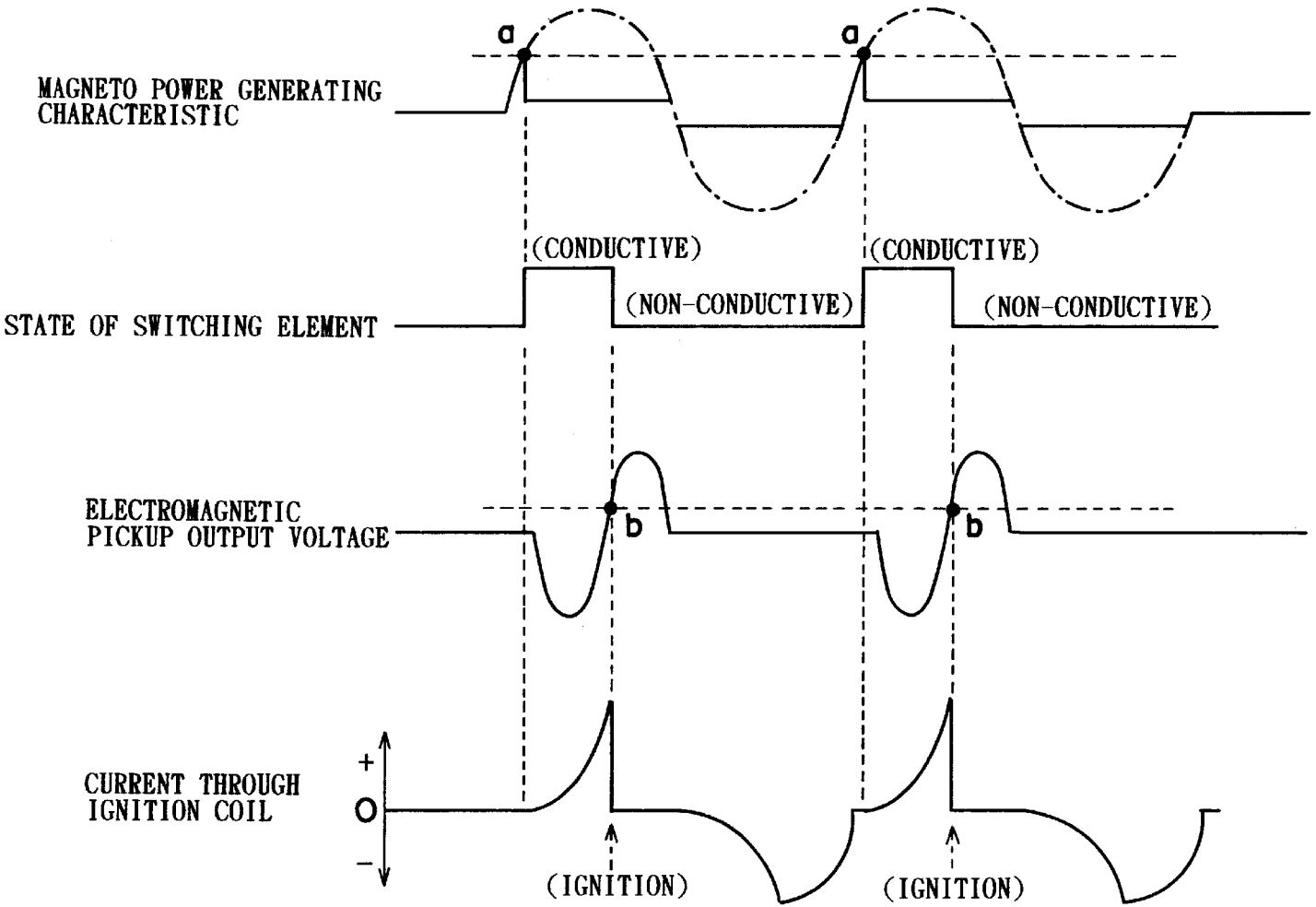
FIG. 16 indicates the output voltage of an electromagnetic pickup, and the operation of a switching element.

The operation of the ignition apparatus constructed as described above will be described with reference to FIG. 16. The magneto-generated voltage at the ignition coil device 16 has a sine waveform with two periods occurring per rotation of the magneto shaft 14, because the permanent magnet 10 has four poles. The sine waveform is indicated by a one-dot chain line in FIG. 16. When the magneto-generated voltage reaches a threshold voltage (indicated by a in FIG. 16), the voltage is applied to the gate of the switching element 221, so that the switching element 221 switches on. As a result, both ends of the primary coil 161 become grounded, so that the magneto voltage decreases. However, since a voltage is retained by the capacitor 50, the switching element 221 remains in the on-state.

The electromagnetic pickup 32 generates negative voltage when the protrusion 361 or 362 of the rotating disc 34 approaches the electromagnetic pickup 32. The electromagnetic pickup 32 generates positive voltage when the protrusion 361 or 362 moves away from the electromagnetic pickup 32. The timing (indicated by point b in FIG. 16) at which the positive voltage reaches the threshold voltage of the thyristor 82 is set as an ignition timing. The timing with magneto power generation is adjusted so that at the aforementioned ignition timing, a sufficiently large current will be flowing through the ignition coil device 16. In this embodiment, the ignition timing is set at a time point (indicated by point b) that is past 45° in the magneto generation waveform. When the point is reached, the thyristor 82 switches on. In response, the gate potential of the switching element 221 falls approximately to the ground potential, so that the switching element 221 switches off.

The switching off of the switching element 221 sharply cuts off the current through the primary coil 161, so that great voltage is induced in the secondary coil 162 and causes discharge from the ignition plug 18.

Once the thyristor 82 switches on, the thyristor 82 remains on until the current through the thyristor 82 becomes zero or until a reverse voltage is applied between the anode and the cathode of the thyristor 82 (that is, until the cathode end voltage becomes higher than the anode end voltage) Therefore, even if the output signal from the electromagnetic pickup 32 becomes lower than the threshold voltage of the thyristor 82, the thyristor 82 allows forward current so as to maintain the off-state of the switching element 221 as long as the magneto-generated power is in the positive (+) direction. When the magneto-generated power becomes zero or negative (−), the thyristor 82 switches off. At this moment, however, a voltage equal to or greater than the threshold voltage is not applied to the gate of the switching element 221, so that the switching element 221 remains off. The switching element 221 switches on when the magneto-generated power becomes equal to or greater than the threshold voltage during the next period. Therefore, the switching element 221 is on only between the point a and the point b, and ignition of the ignition plug 18 is performed at the switching-off timing of the switching element 221. Negative magneto-generated power is cut off by the diode 201.

This embodiment switches on the switching element 221 by using magneto-generated power. The embodiment switches off the switching element 221 by using the output signal of the electromagnetic pickup. Therefore, compared with a construction that switches the element on and off by using only the output signal of the electromagnetic pickup 32, the embodiment increases the freedom in the control of the electrification duration of the ignition coil device 16 while the switching element 221 remains on. As a result, the control becomes easier.

Although the first to sixth embodiments have been described separately, it is also preferable to combine any one or more of the embodiments and accordingly construct an ignition apparatus.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements.

What is claimed is:

1. An ignition apparatus of an internal combustion engine, comprising:

a generator that has a primary coil and a secondary coil that generates an induced voltage in the secondary coil by using an induced current that flows through the primary coil based on rotation of an output shaft of the internal combustion engine;

means for generating the induced voltage in the secondary coil by discontinuing the induced current and for applying the induced voltage to an ignition plug of the internal combustion engine;

two semiconductor switching elements connected to the opposite ends of the primary coil, each of the semiconductor switching elements controlling one of discontinuation and conduction of a current through the primary coil; and element drive signal generation means for generating a signal that switches each of the semiconductor switching elements on and off based on the rotation of the output shaft, the element drive signal generation means generating an element drive signal so that each of the semiconductor switching elements switches from an on-state to an off-state at a timing at which ignition of the ignition plug is to be performed.

2. An ignition apparatus of an internal combustion engine according to claim 1, further comprising:

an external power source that supplies current to the primary coil; and second element drive signal generation means for, when the current from the external power source is supplied to the primary coil, generating a second element drive signal that controls switch on and off of the semiconductor switching elements, independently of the element drive signal.

3. An ignition apparatus of an internal combustion engine according to claim 1, wherein the element drive signal generation means is an electromagnetic pickup.

4. An ignition apparatus of an internal combustion engine according to claim 1, comprising:

a comparator that converts an analog signal generated by the element drive signal generation means into a digital signal and that outputs an output signal that switches the semiconductor switching elements on and off; and a comparator operating power source portion that is electrically charged by an induced current generated by rotation of an ignition power generating permanent magnet and that supplies the comparator with an operating power.

5. An ignition apparatus of an internal combustion engine according to claim 4, further comprising:

an external power source that supplies a current to the primary coil; and second element drive signal generation means for, when the current from the external power source is supplied to the primary coil, generating a second element drive signal that controls switch on and off of the semiconductor switching elements, independently of the element drive signal.

6. An ignition apparatus of an internal combustion engine, comprising:

a generator that has a primary coil and a secondary coil that generates an induced voltage in the secondary coil by using an induced current that flows through the primary coil based on rotation of an output shaft of the internal combustion engine;

means for generating the induced voltage in the secondary coil by discontinuing the induced current and for applying the induced voltage to an ignition plug of the internal combustion engine;

two semiconductor switching elements connected to the opposite ends of the primary coil, each of the semiconductor switching elements controlling one of discontinuation and conduction of a current through the primary coil;

element switching-on signal generation means for generating a signal that switches each of the semiconductor switching elements on based on the induced current through the primary coil, and element switching-off signal generation means for generating a signal that switches each of the semiconductor switching elements off based on the rotation of the output shaft, the element switching-on signal generation means and the element switching-off signal generation means generating an element drive signal so that each of the semiconductor switching elements switches from an on-state to an off-state at a timing at which ignition of the ignition plug is to be performed.

* * * * *